US006612299B2

(12) United States Patent
Martin et al.

(10) Patent No.: US 6,612,299 B2
(45) Date of Patent: Sep. 2, 2003

(54) ARCHERY BOWS, CONNECTOR APPARATUSES AND RINGS FOR ARCHERY BOW ACCESSORIES, AND METHODS FOR REMOVABLE SECURING ARCHERY BOW ACCESSORIES TO ARCHERY BOWS

(75) Inventors: Dan J. Martin, Walla Walla, WA (US); Dave Conlee, Milton-Freewater, OR (US)

(73) Assignee: Martin Archery, Inc., Walla Walla, WA (US)

( * ) Notice: Subject to any disclaimer, the term of this patent is extended or adjusted under 35 U.S.C. 154(b) by 0 days.

(21) Appl. No.: 09/941,351

(22) Filed: Aug. 28, 2001

(65) Prior Publication Data

US 2003/0041850 A1 Mar. 6, 2003

(51) Int. Cl.[7] ..... F41B 5/14; F16B 21/04; F41G 1/467

(52) U.S. Cl. ..... 124/86; 124/87; 33/265; 403/322.4; 403/349

(58) Field of Search ..... 33/265; 124/86, 124/87, 88, 89; 403/322.4, 323, 348, 349

(56) References Cited

U.S. PATENT DOCUMENTS

| | | | | |
|---|---|---|---|---|
| 4,263,718 A | | 4/1981 | Smith | 33/265 |
| 4,615,326 A | | 10/1986 | Rathbun | 124/88 |
| 4,662,347 A | | 5/1987 | Carlton | 124/87 |
| 4,703,745 A | | 11/1987 | Hammond | 124/44.5 |
| 4,756,638 A | * | 7/1988 | Neyret | 403/349 X |
| 4,788,961 A | | 12/1988 | Toth | 124/25.5 |
| 4,889,102 A | | 12/1989 | Martin | 124/88 |
| 4,893,426 A | * | 1/1990 | Bixler | 403/348 X |
| 4,967,722 A | | 11/1990 | Roberts | 124/44.5 |
| 5,239,977 A | | 8/1993 | Thomas | 124/89 |
| 5,597,260 A | * | 1/1997 | Peterson | 403/348 X |
| 5,911,215 A | | 6/1999 | Fisher, Jr. | 124/86 |
| 5,947,531 A | | 9/1999 | Eckard et al. | 285/319 |
| 6,004,064 A | * | 12/1999 | Franz | 403/322.4 |

* cited by examiner

*Primary Examiner*—John A. Ricci
(74) *Attorney, Agent, or Firm*—Wells St. John P.S.

(57) ABSTRACT

A connector apparatus for removably securing an archery bow accessory to an archery bow. The connector apparatus includes a base that is discrete from the archery bow. The base has a first portion configured for removably securing the archery bow accessory thereon and a second portion spaced from the first portion. The second portion defines a stem that extends axially from the second portion. The stem terminates to define at least one projection extending laterally and generally perpendicularly relative the stem axis. The projection is spaced from the second portion of the base. The invention further includes a discrete body to be removably secured to an archery bow. The discrete body defines an outer surface and bore having a peripheral wall extending from the outer surface to a lowermost elevation spaced from the outer surface. A pair of ledges extend laterally inwardly from opposite sides of the peripheral wall, and the pair of ledges are spaced from the lowermost elevation.

34 Claims, 9 Drawing Sheets

ARCHERY BOWS, CONNECTOR APPARATUSES AND RINGS FOR ARCHERY BOW ACCESSORIES, AND METHODS FOR REMOVABLE SECURING ARCHERY BOW ACCESSORIES TO ARCHERY BOWS

TECHNICAL FIELD

The invention pertains to archery bows, connector apparatuses and rings for archery bow accessories, and methods for removably securing archery bow accessories to archery bows.

BACKGROUND OF THE INVENTION

The archery industry continues to develop archery bow accessories to enhance the enjoyment of the sport. Some exemplary archery bow accessories are configured for attachment directly to an archery bow to facilitate use of the archery bow. For example, sighting mechanisms are developed to facilitate the accuracy of aiming an arrow at a target.

Designing archery bow accessories to be removably secured to a bow has advantages. Such provides the opportunity to interchange accessories on a single bow thereby increasing the versatility of the single bow. For example, one accessory may be designed for use during target practice or archery competition, while another accessory may be designed for use during hunting. If the two accessories are configured to be removably secured to the bow, and interchangeable, the same bow can be provided for the different archery activities. Another advantage is the bow can be made lightweight and compact for long travels and hiking in dense brush, for example, during hunting.

Accordingly, accessories are designed to be removably secured to bows. Some exemplary accessories, such as sighting mechanisms, are desired to be tightly secured to a bow to provide a consistent and stable orientation relative the bow. However, some existing designs and methods for securing an accessory to a bow provide inconsistent and unstable orientations relative the bow. For example, an exemplary design and method includes an accessory having a threaded shaft to be received in complementary fashion in a threaded bore provided in the bow. However, the action of continually threading the accessory in, and alternatively out, of the threaded bore weakens the stability of the threaded connection. Even a minor deterioration of the threaded connection can alter the orientation of an accessory relative the bow. In the case of a sighting mechanism, such a minor alteration of the orientation of the sighting mechanism relative the bow can alter the accuracy of the bow to such a degree as to effectively negate the purpose of the sighting mechanism. Furthermore, as the threaded connection deteriorates, the accessory can no longer be secured to the bow with a consistent placement for each time the accessory is installed.

Accordingly, it would be desirable to develop improved connector apparatuses and methods to secure archery bow accessories to archery bows. Furthermore, it would be desirable to develop connection apparatuses and methods that consistently orient and align the accessories relative the bow during each installation, and once secured to the bow, maintain the orientation and alignment in a stable position.

SUMMARY OF THE INVENTION

In one aspect, the invention includes a connector apparatus for removably securing an archery bow accessory to an archery bow. The connector apparatus includes a base that is discrete from the archery bow. The base has a first portion configured for removably securing the archery bow accessory thereon and a second portion spaced from the first portion. The second portion defines a stem that extends axially from the second portion. The stem terminates to define at least one projection extending laterally and generally perpendicularly relative the stem axis. The projection is spaced from the second portion of the base.

In another aspect, the invention includes a connector ring to be removably secured to an archery bow. The connector ring includes a discrete body that defines an outer surface and an opening. The opening has a peripheral wall extending from the outer surface to a lowermost elevation spaced from the outer surface. A pair of ledges extend laterally inwardly from opposite sides of the peripheral wall, and the pair of ledges are spaced from the lowermost elevation.

In yet another aspect, the invention includes an archery bow having a handle with a first end, a second end opposite the first end, and an outer surface. The handle defines an opening having a peripheral wall extending from the outer surface to a lowermost elevation in the handle spaced from the outer surface. A pair of ledges extend laterally inwardly from opposite sides of the peripheral wall. The pair of ledges are spaced from the lowermost elevation. A first limb extends outwardly from the first end of the handle and a second limb extends outwardly from the second end of the handle. At least one string extends between distal ends of the limbs.

In still another aspect, the invention includes a method for removably securing an archery bow accessory to an archery bow. The archery bow is provided with an outer surface defining an opening. The opening has peripheral walls extending from the outer surface into the bow to define a bottom wall spaced from the outer wall. A pair of ledges extend laterally inwardly from opposite sides of the peripheral wall and are spaced from the bottom wall. A base discrete from the bow is provided with a first portion configured for removably securing the archery bow accessory thereon and a second portion spaced from the first portion. A stem defines a stem axis and extends axially from the second portion. The stem terminates to define a pair of projections extending laterally in opposite directions generally perpendicular to the stem axis. At least a portion of the stem is axially positioned in the opening of the bow.

BRIEF DESCRIPTION OF THE DRAWINGS

Preferred embodiments of the invention are described below with reference to the following accompanying drawings.

FIG. 7 is a bottom side view of a base in accordance with an embodiment of the present invention.

FIG. 16 is a fragmentary perspective view of a connector apparatus at one method step for removably securing an archery bow accessory onto an archery bow in accordance with a second embodiment bracket of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
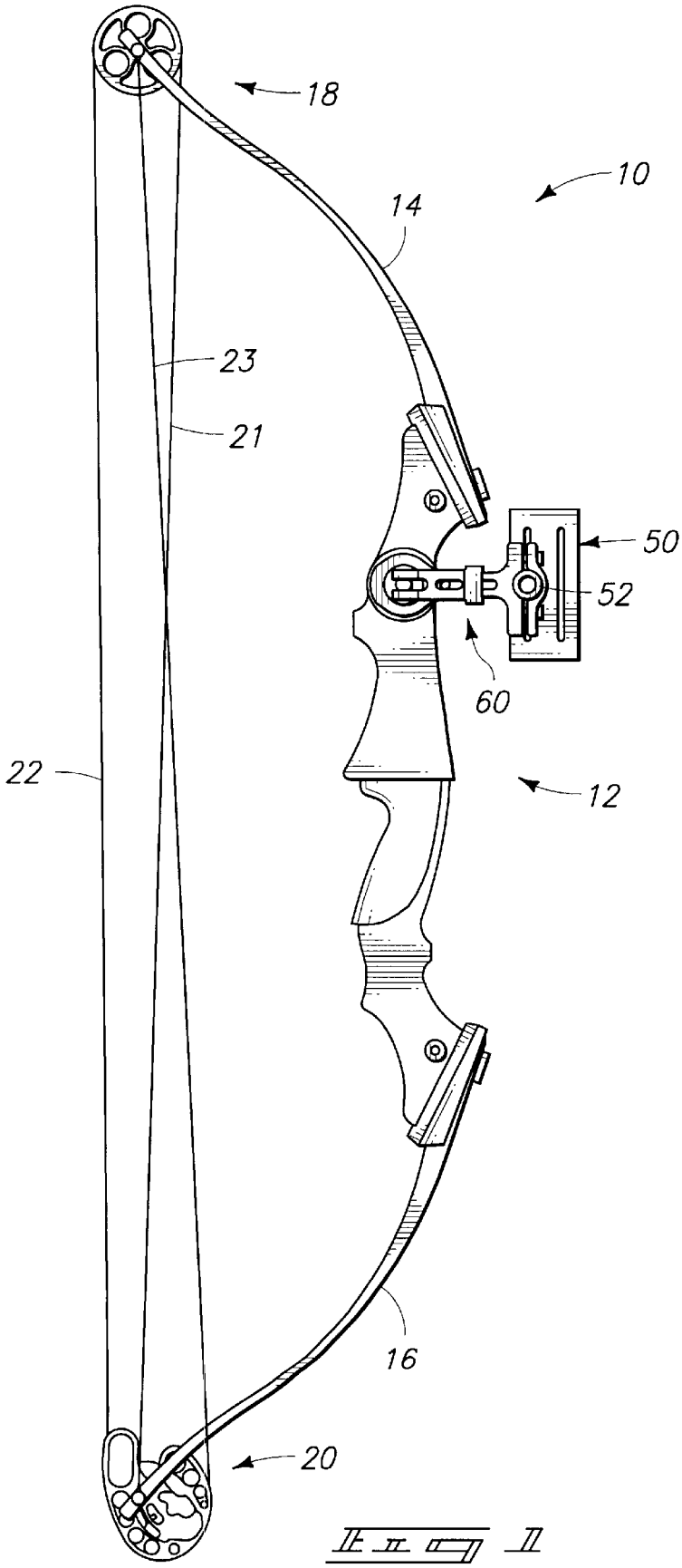
FIG. 1 is a diagrammatic side view of an archery bow in accordance with an embodiment of the present invention.

FIG. 1 illustrates an embodiment of an archery bow 10 in accordance with the present invention. Archery bow 10 includes a central elongated handle or body 12 having resilient limbs 14 and 16 secured to opposite ends of the handle 12. Archery bow 10 further includes rotating members 18 and 20 rotatably secured to limbs 14 and 16, respectively. A cable, or drawstring 22 extends between limbs 14 and 16 over respective rotating members 18 and 20. A plurality of cables 21 and 23, for example power cables, extend between first and second limbs 14 and 16. The illustrated archery bow is commonly referred to as a compound bow. However, other bows could be employed, such as recurve and longbows, without departing from the principles and scope of the invention. Furthermore, this exemplary compound bow illustrates rotating member 18 as a pulley and rotating member 20 as a camming device. However, other compound bows could be employed, for example, wherein rotating members 18 and 20 are both camming devices, and further wherein the camming apparatuses have different designs.

Archery bow 10 further includes a connector apparatus 60 secured to handle 12, and an archery bow accessory 50 secured to the connector apparatus 60 via a cylindrical portion 52 such as a barrel (FIG. 4) secured between accessory 50 and apparatus 60. An exemplary bow accessory includes an archery bow sighting mechanism, although other archery bow accessories can be employed without departing from the principles and scope of the invention. Connector apparatus 60 is secured to archery bow 10 via a connector or engagement ring 66 (also referred to as a mounting ring).

Figure 2:
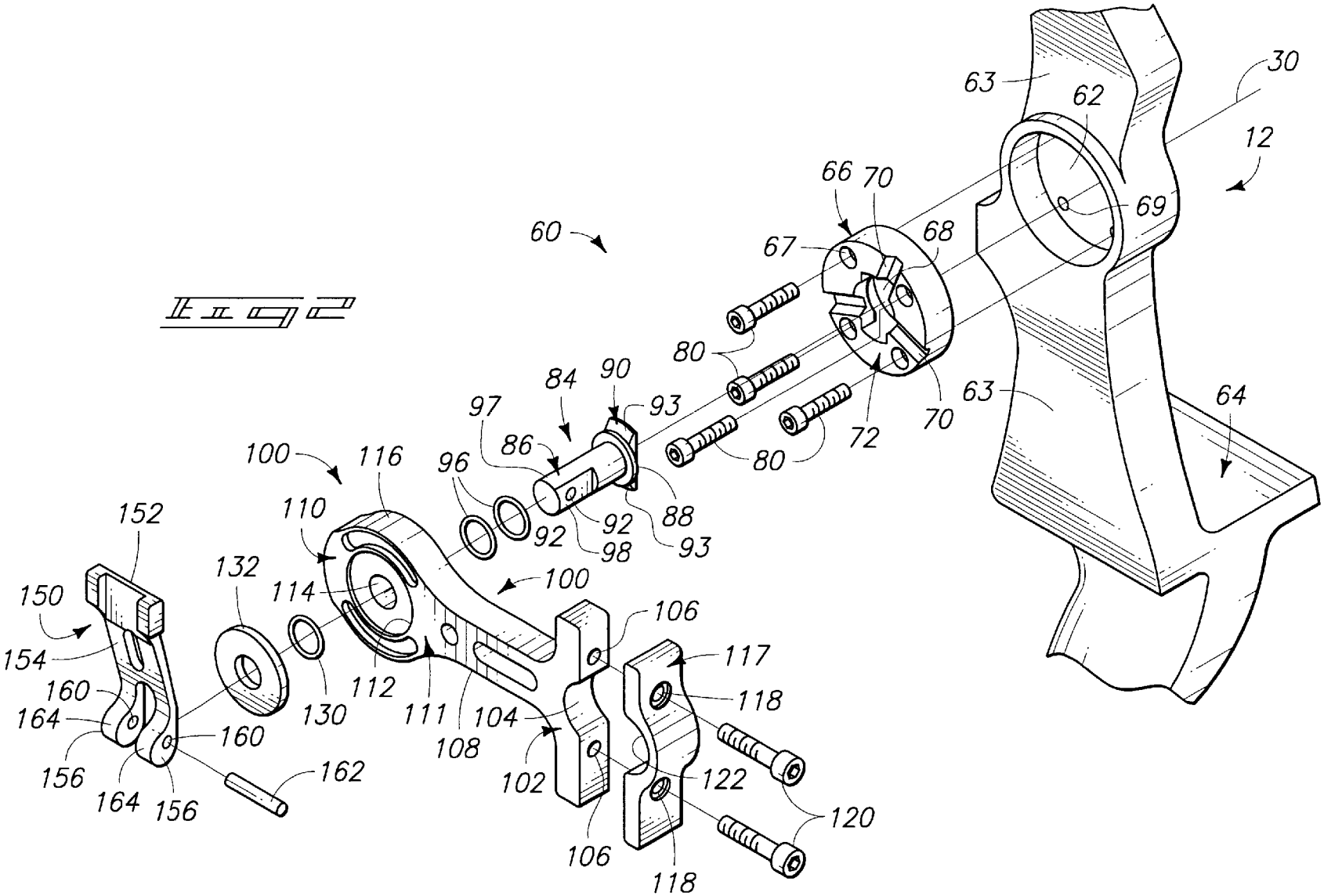
FIG. 2 is an exploded view of a connector apparatus for archery bow accessories in accordance with an embodiment of the present invention.
Figure 2:
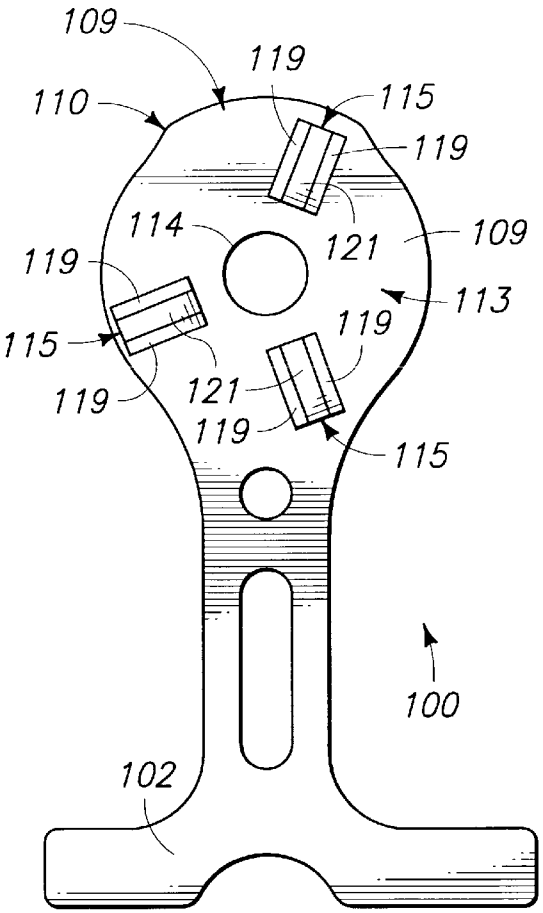

Referring to FIG. 2, connector apparatus 60 and engagement ring 66 are shown oriented to be secured to handle 12 of bow 10 (FIG. 1) along an alignment axis. Such alignment axis corresponds to a stem axis 30 referred to throughout this document. Handle 12 defines an outer side surface 63 opposite an arrow rest 64, and the outer side surface 63 has a cylindrical opening 62 formed therein. Cylindrical opening 62 receives connector ring 66 removably secured therein by threaded members 80 positioned in respective aligned openings 67 (only one numbered) and 69 (only one shown). The connector ring 66 is a discrete, generally cylindrical body and defines an outer surface 72 and an opening 68. Opening 68 extends from the outer surface 72 to a lowermost elevation (FIGS. 5 and 6) spaced from the outer surface 72. A locking pin 84 is axially received in opening 68 of ring 66. Locking pin 84 includes a head portion 90 and a stem portion 86 (also referred to as a stem) which extends axially from the head portion 90 along stem axis 30. The head portion 90 has a pair of projections 93 that extend laterally in opposite directions generally perpendicularly relative the stem axis 30, and a circular guide 88 generally perpendicular to the stem axis 30. Stem portion 86 includes an end 97 opposite the head portion 90, and end 97 defines a pivot opening 92 extending generally perpendicularly to the stem axis 30. While stem portion 86 is generally cylindrical immediately adjacent head portion 90, end 97 includes a pair of generally parallel and planar surfaces 98 (only one shown) on opposite sides of stem portion 86. A plurality of o-rings 96 slide over stem portion 86 of locking pin 84. It should be understood that the head portion 90 may terminate to define only one projection 93, or three or more projections 93, which extend laterally and generally perpendicularly relative the stem axis 30. It should be further understood that such configurations of head portion 90 would include configurations of connector ring 66 to complementarily receive the head portion 90 that defines only the one projection 93, or the three or more projections 93, respectively.

Still referring to FIG. 2, a base 100 discrete from bow 10 has a first generally planar side 111 opposite a second generally planar side 113 (FIG. 7), and a first portion 102 spaced from a second portion 110. The first portion 102 is configured for removably securing accessory 50 (FIG. 1) thereon by positioning a bracket 117 over barrel 52 and securing bracket 117 to the first portion 102 by threaded members 120. First portion 102 and bracket 117 define concave surfaces 104 and 122, respectively, to facilitate receipt of barrel 52 and securement therebetween. Second portion 110 defines an opening 114 that extends between first and second sides 111 and 113, and is configured generally as a cylindrical bore. Bore 114 receives stem portion 86 therein for sliding cooperation along the stem axis 30 and rotating cooperation about the stem axis 30. Stem portion 86 is positioned in bore 114 with head portion 90 outward of side 113 (FIG. 7) and end 97 outward of side 111, which includes pivot opening 92 and at least portions of planar surfaces 98 outward of side 111. A resilient member 130, for example an o-ring, and a washer 132 are received over end 97 of stem portion 86 and received in circular recess 112 defined in side 111 of base 100. A lever 150 is pivotally connected to locking pin 84 and is pivotable about a pivot axis generally perpendicular to the stem axis 30. Such pivot action of lever 150 establishes a range of pivot motion (referenced as 170 in FIG. 13). Lever 150 includes a pivot end for the pivot connection and includes a pair of prongs 156 laterally aligned and spaced to be received over the planar surfaces 98 of locking pin 84. Prongs 156 define aligned pin openings 160, which are aligned with pivot opening 92 of locking pin 84 for receipt of pivot pin 162 to establish the pivotal connection. The pivot axis is along pivot pin 162. Prongs 156 define laterally aligned eccentric peripheral surfaces 164 radially spaced about the pivot axis and at least partially surrounding the pivot axis. The eccentric peripheral surfaces 164 contact washer 132 of base 100 during at least a portion of the range of pivot motion to bias the pivot pin 162, and correspondingly the locking pin 84, along the stem axis 30 to axially move the locking pin 84 in bore 114 of base 100. An exemplary range of pivot motion for lever 150 approximates 180° and includes two directions, one direction opposite the other direction.

The radial spacing between the eccentric peripheral surfaces 164 and pivot axis provides a varying dimension that varies as the eccentric peripheral surfaces 164 surrounds the pivot axis by the very definition of eccentricity. An exemplary varying dimension of the present invention includes eccentric peripheral surfaces 164 that do not vary at a constant rate as the lever 150 moves in a direction through the range of pivot motion. That is, as the lever 150 moves through the range of pivot motion, the varying dimension increases to reach a peak dimension (the general location referenced as 165 in FIG. 14) intermediate the range of pivot motion, and then the varying dimension decreases as the lever 150 finishes the balance of the range of pivot motion. Accordingly, as the lever 150 moves through the range of pivot motion, the biasing force on locking pin 84 increases as the varying dimension increases, peaks as the varying dimension peaks, and decreases as the varying dimension decreases. In such an embodiment of eccentric peripheral surfaces 164, it should be understood that once lever 150 moves past the peak dimension and the varying dimension begins to decrease, lever 150 will be locked at a position in the range of pivot motion past the peak dimension. That is, if the final range of pivot motion positions lever 150 against base 100, lever 150 will remain biased against base 100 until a force is applied in the opposite direction. It should be understood that other embodiments of the eccentric peripheral surfaces 164 are possible, for example, wherein the varying dimension varies at a constant rate, wherein the varying dimension increases in a portion of the range of motion of lever 150 with the rate of the varying being constant or variable, wherein the varying dimension decreases in a portion of the range of motion of lever 150 with the rate of the varying being constant or variable, and any combination thereof.

Figure 4:
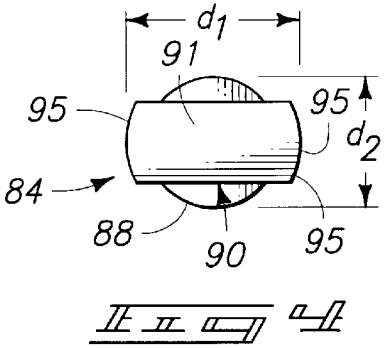
FIG. 4 is a top end view of the locking pin of FIG. 3.
Figure 3:
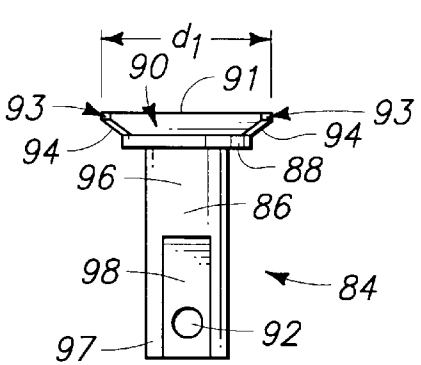
FIG. 3 is a side elevation view of a locking pin in accordance with an embodiment of the present invention.

Referring to FIGS. 3 and 4, head portion 90 of locking pin 84 includes the pair of projections 93 with an outermost upper planar surface 91 which terminates to define a pair of arcuate surfaces 95 spaced apart a dimension represented by $d_1$. Head portion 90 provides a pair of engagement surfaces 94 extending downwardly relative planar surface 91 from arcuate surfaces 95 and angling inwardly toward the stem axis 30. Engagement surfaces 94 terminate to form circular guide 88. Referring to FIG. 4, circular guide 88 has a diametric dimension $d_2$ wherein $d_2$ is smaller than $d_1$. The top plan view of head portion 90 illustrated in FIG. 4 is received first axially in opening 68 of ring 66 along the stem axis 30.

Figure 6:
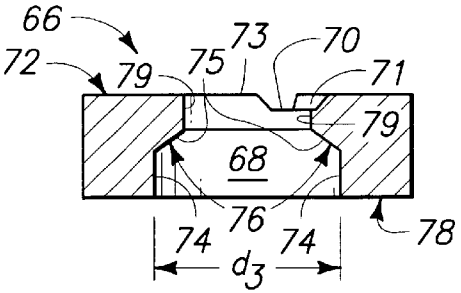
FIG. 6 is a side sectional view of the mounting ring of FIG. 5 taken along line 6—6 of FIG. 5.
Figure 5:
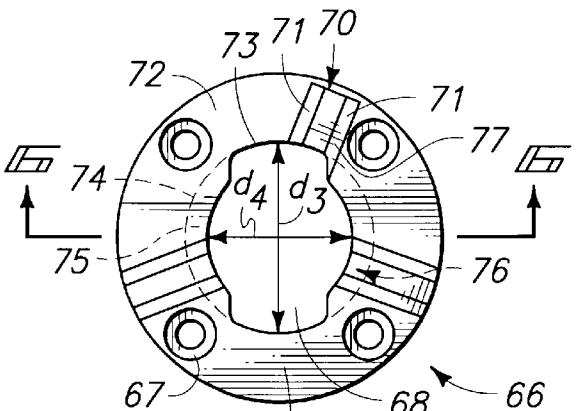
FIG. 5 is a top plan view of a mounting ring in accordance with an embodiment of the present invention.

Referring to FIGS. 5 and 6, opening 68 of ring 66 is defined by a peripheral wall that extends from outer surface 72 to the lowermost elevation of ring 66. The lowermost elevation comprises a planar wall 78 spaced from and generally parallel to outer surface 72 of ring 66. Outer surface 72 has a periphery 73 of opening 68 and includes a first dimension $d_3$ configured to accommodate receipt of dimension $d_1$ of planar surface 91, and a second dimension $d_4$ configured to accommodate receipt of cylindrical guide portion 88 which has a dimension $d_2$. First dimension $d_3$ is larger than second dimension $d_4$. It should be understood that opening 68 at periphery 73 can accommodate receiving head portion 90 of locking pin 84 axially only with arcuate surfaces 95 adjacent the periphery 73 defined by the first dimension $d_3$. That is, top plan view of head portion 90 is configured to have the same contour as periphery 73 to allow generally only axial receipt therein. Since head portion 90 has a symmetric configuration, opening 68 can receive head portion 90 axially in two orientations, one orientation with head portion 90 rotated 180° about the stem axis 30 from the other orientation. First dimension $d_3$ of periphery 73 extends elevationally from outer surface 72 to planar wall 78 and includes a portion of peripheral wall 74. Outer surface 72 defines a plurality of slots 70 radially extending from and spaced about opening 68. Slots 70 comprise a pair of angled walls 71 that extend downwardly and inwardly from outer surface 72 and terminate to form a planar surface 77 generally parallel to outer surface 72.

Referring to FIG. 6, peripheral wall 74 defines opening 68 in planar wall 78 of ring 66 and is configured as a cylinder with dimensions of $d_3$ to accommodate receiving head portion 90 axially therein and to accommodate head portion 90 rotating 360° about the stem axis 30. Accordingly, a portion of peripheral wall 74 is defined beneath second dimension $d_4$ of periphery 73. Second dimension $d_4$ of periphery 73 extends from the outer surface 72 to define peripheral wall 79 which extends elevationally into opening 68. Peripheral walls 79 and 74 are connected by peripheral wall 75 of opening 68 and angles outwardly from peripheral wall 79 to peripheral wall 74. Such peripheral wall orientation of opening 68 comprises ledges 76 over peripheral wall 74. The angled configuration of peripheral wall 75 complements the angled configuration of engagement surfaces 94 of locking pin 84 for complementary abuttment thereof.

Referring to FIG. 7, base 100 is shown illustrating side 113 which is generally planar and parallel to opposite side 111. Side 113 of second portion 110 has an outer face 109 having generally a circular configuration around opening 114. Outer face 109 is to be received adjacent bow 10 abutting against outer surface 72 of ring 66. Outer face 109 provides a plurality of extensions 115 projecting outwardly from outer face 109 and terminating with a generally planar outermost surface 121 parallel to outer face 109. Inwardly angled surfaces 119 extend outward from outer face 109 to terminate defining the outermost surfaces 121. Extensions 115 extend radially from and spaced about opening 114 of base 100. As outer face 109 is positioned adjacent outer surface 72 of ring 66, extensions 115 engage slots 70 to accurately orient and align base 100 relative ring 66, and correspondingly accurately orient and align accessory 50 relative bow 10. An exemplary material for the locking pin 84 is stainless steel. An exemplary material for the ring 66 is titanium to prevent any wear or deterioration of the slots 70 defined by outer surface 72 to achieve consistent orientation and alignment each time the accessory 50 is secured to the bow 10, and once secured to the bow 10, maintain the orientation and alignment in a stable position. It should be understood that extensions 115 and slots 70 could have any complementary configuration. It should be understood that extensions 115 could be defined from ring 66 and slots 70 defined in base 100.

Method of Operation

Figure 8:
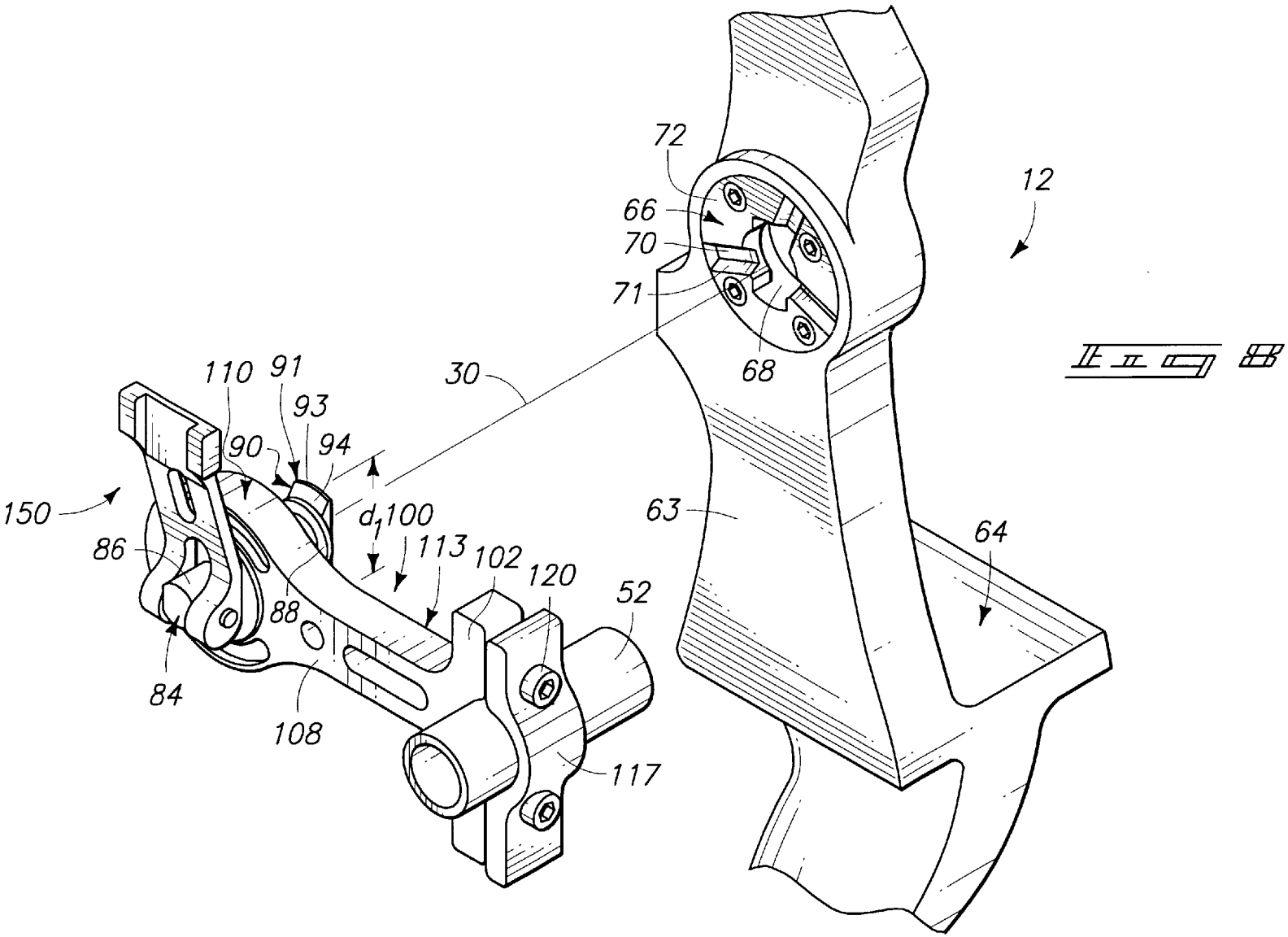
FIG. 8 is a fragmentary perspective view of a connector apparatus at one method step for removably securing the connector apparatus to the archery bow in accordance with an embodiment of the present invention.

Referring to FIGS. 8–15, an exemplary method of removably securing the base 100 to ring 66, and correspondingly to handle 12 of archery bow 10, is illustrated according to an embodiment of the present invention. Referring to FIG. 8, base 100 is oriented with second side 113 to face side surface 63 of handle 12 with outer face 109 (not shown) of second portion 110 aligned to be positioned over outer surface 72 of ring 66. Lever 150 is rotated about the stem axis 30 to position head portion 90 of locking pin 84 for axial receipt in opening 68 of ring 66. It should be understood that lever 150 could begin in a position extending upward from base 100, or rotated generally 1800 from the upward position shown to begin in a downwardly extending position without deviating from the invention.

Figure 9:
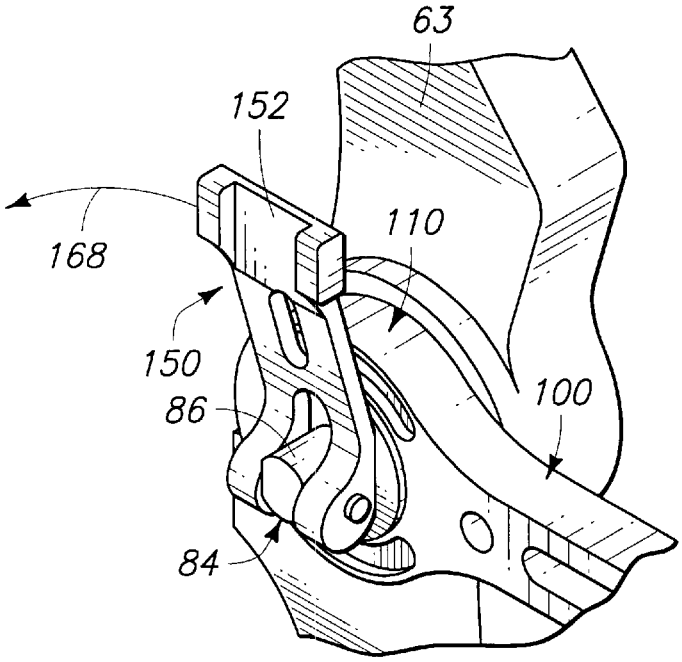
FIG. 9 is a fragmentary view of the FIG. 8 connector apparatus at a method step subsequent to that shown in FIG. 8.

Referring to FIG. 9, head portion 90 is positioned axially in opening 68. Extensions 115 (not shown) of base 100 slidingly engage slots 70 (not shown) of ring 66 to align base 100 relative bow 10.

Figure 10:
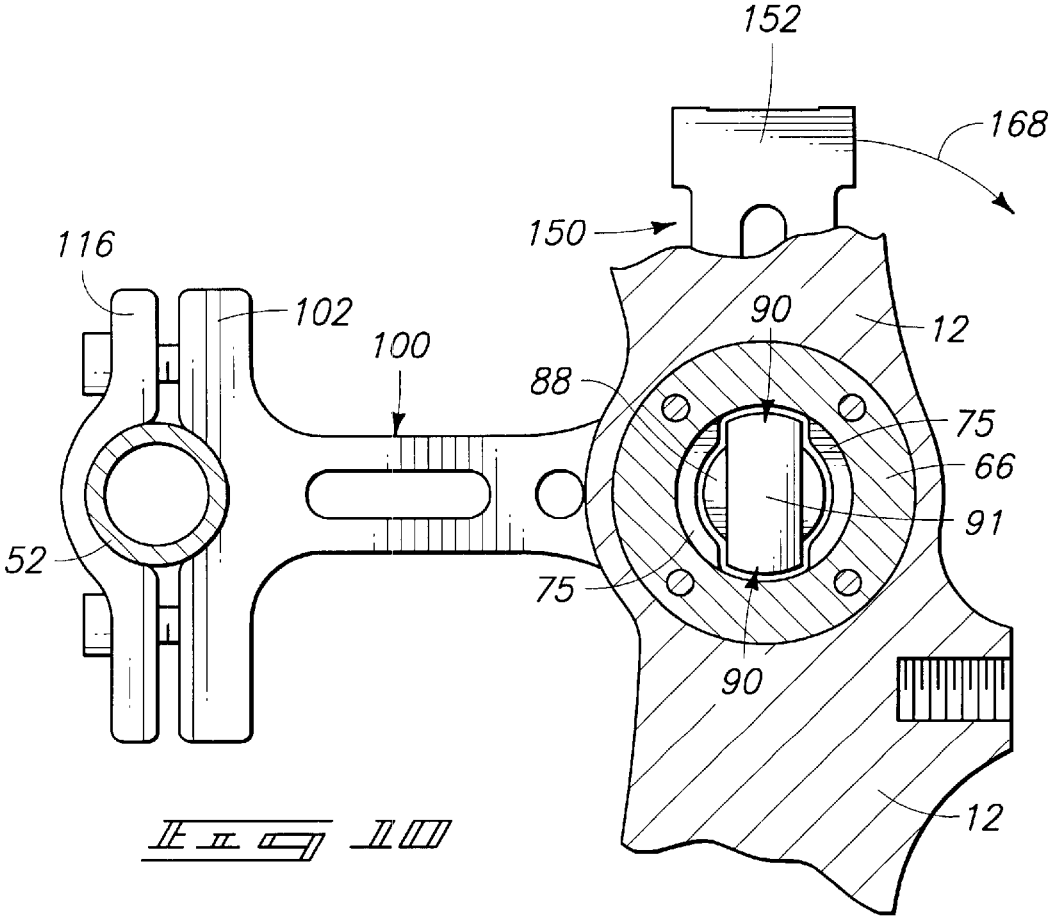
FIG. 10 is a fragmentary, side, partial, longitudinal, sectional view of the connector apparatus at the method step orientation shown in FIG. 9.

Referring to FIG. 10, stem portion 86 slides axially elevationally into opening 68 as originally aligned in FIG. 8 to allow head portion 90 of locking pin 84 to move adjacent peripheral wall 75. Lever 150 is rotated about the stem axis 30 as indicated by arrow 168 approximately 90° clockwise from this perspective (counterclockwise from the perspective of FIG. 9).

Figure 11:
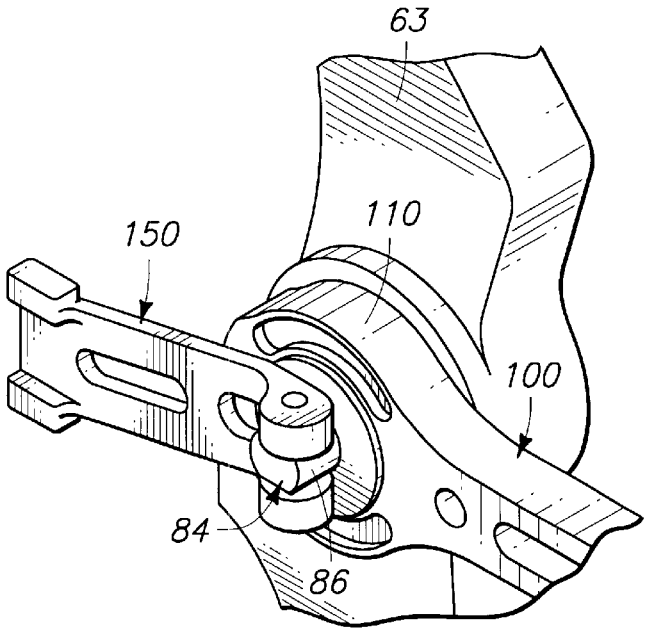
FIG. 11 is a view of the FIG. 9 connector apparatus at a method step subsequent to that shown in FIG. 9.

Referring to FIG. 11, after the rotation of lever 150 as described in FIG. 10, lever 150 is oriented in the nine o'clock position extending outwardly from base 100.

Figure 12:
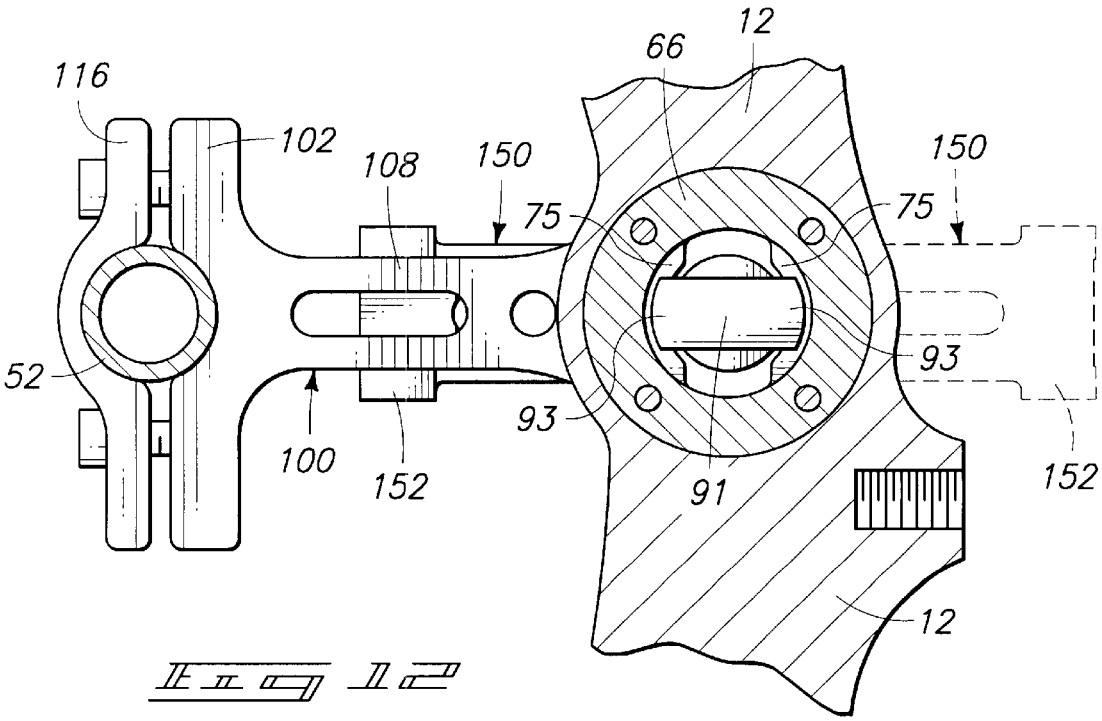
FIG. 12 is a view of the FIG. 10 connector apparatus and illustrates an orientation of a lever in a partial phantom view to show a method step orientation subsequent to that shown in FIG. 10 and corresponds to the method step orientation shown in FIG. 11; and illustrates an orientation of the lever in a solid line view to show a method step orientation subsequent to that shown in FIG. 11.

Referring to FIG. 12, after the rotation of lever 150 as described in FIG. 10, the position of lever 150 is shown in phantom. The pair of projections 93 of locking pin 84 have been rotated about stem axis 30 to be positioned beneath peripheral wall 75 relative outer surface 72 of ring 66.

Figure 13:
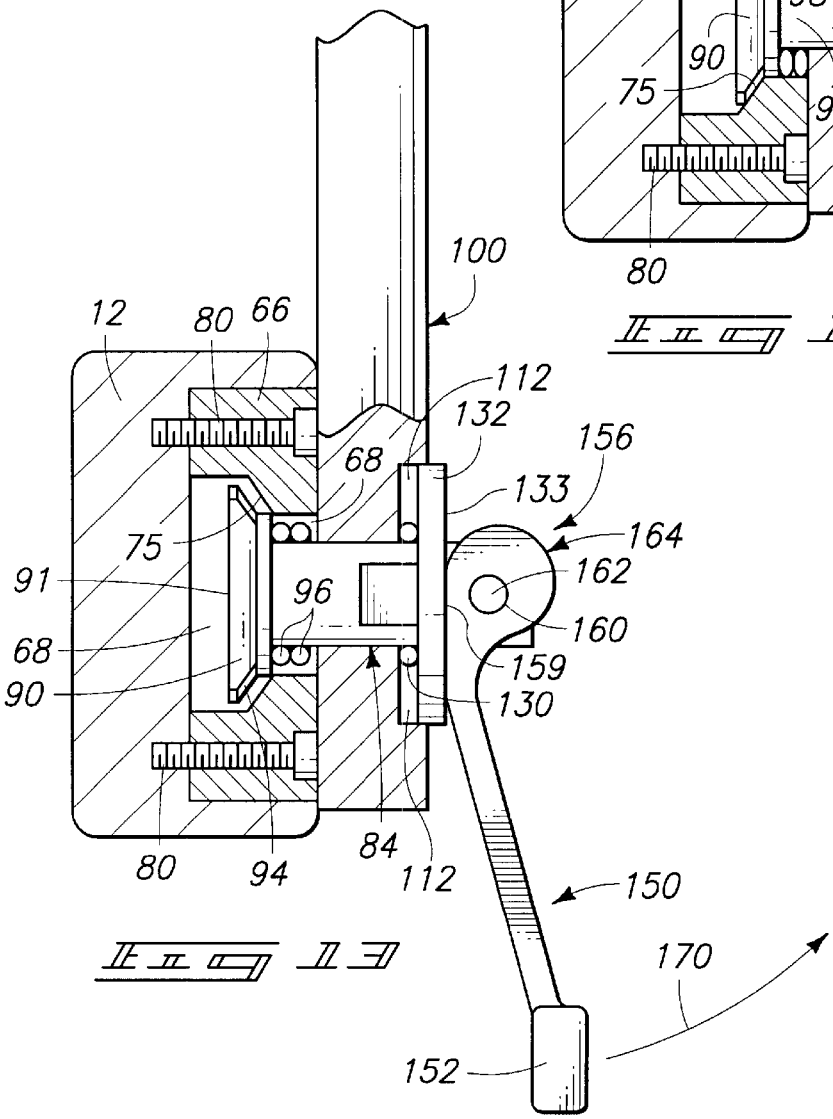
FIG. 13 is a fragmentary, top, partial, cross-sectional view of the connector apparatus at the method step orientation shown in FIG. 11.

Referring to FIG. 13, after the rotation of lever 150 as described in FIG. 10, the engagement surfaces 94 of locking pin 84 are spaced beneath the peripheral wall 75 of ledges 76. Prongs 156 (one shown) define a portion of the eccentric peripheral surfaces 164 with a planar surface 159 abutting against an upper surface 133 of washer 132. Opposite upper surface 133, resilient member 130 rests between washer 132 and base 100 in circular recess 112. Lever 150 is pivoted in a counterclockwise direction (from this perspective) designated by direction arrow 170 about the pivot axis. Again referring to FIG. 12, the pivoting action of lever 150 about the pivot axis would move lever 150 into the page from this prospective from the phantom illustration of lever 150 for approximately 180° until lever 150 rests against base 100 as illustrated in solid lines. During the pivoting action of lever 150, the pair of projections 93 are generally stationary relative the rotation about the stem axis 30.

Figure 14:
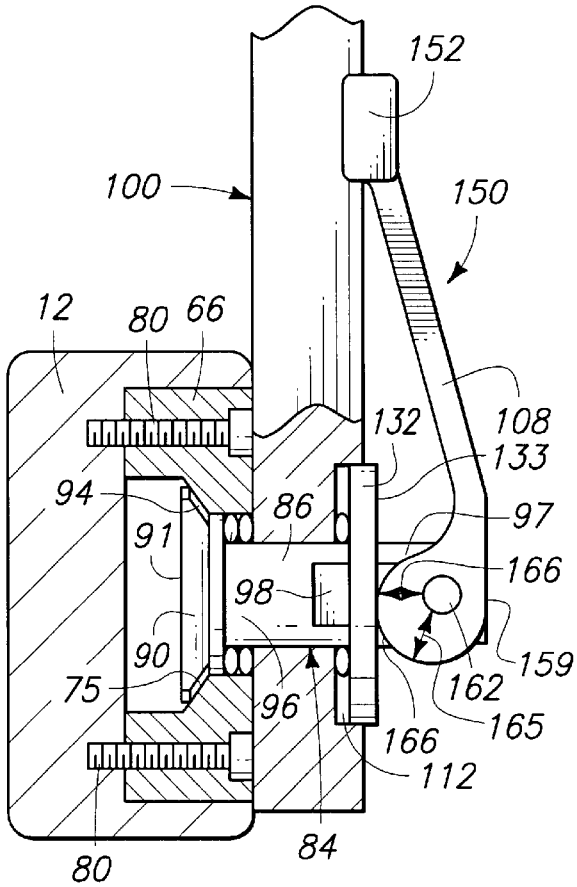
FIG. 14 is a fragmentary, top, partial, cross-sectional view of the connector apparatus at the method step orientation shown with the lever in solid lines in FIG. 12.

Referring to FIG. 14, lever 150 has pivoted about the pivot axis through the range of pivot motion to rest against base 100. Lever 150 includes tabs 152 at a terminal end opposite the prongs 156 which rest along sides of base 100. During the pivoting, the eccentric peripheral surfaces 164 act as camming surfaces and ride against upper surface 133 of washer 132 which acts as a follower for the camming surfaces. Such camming action biases the locking pin 84 upward along stem axis 30 until the engagement surfaces 94 of locking pin 84 abut against peripheral wall 75 of ring 66 in locking cooperation to secure the base 100 against handle 12 of bow 10. To relieve strain on the pivot pin 162 once the engagement surfaces 94 abut against peripheral wall 75, particularly when the pivoting action has not moved the eccentric peripheral surfaces 164 past the peak dimension 165, the resilient member 130 between washer 132 and base 100 compresses with washer 132 descending into circular recess 112. It should be understood that once lever 150 has moved through the range of pivot motion to rest against base 100, eccentric peripheral surfaces 164 bias base 100 with a varying dimension 166 that is smaller than peak dimension 165 such that lever 150 is biased against base. It should be understood that reversing the order of steps of removably securing the base 100 to ring 66 as described previously regarding reference to FIGS. 8–14 will remove the base 100 from handle 12 of bow 10.

Figure 15:
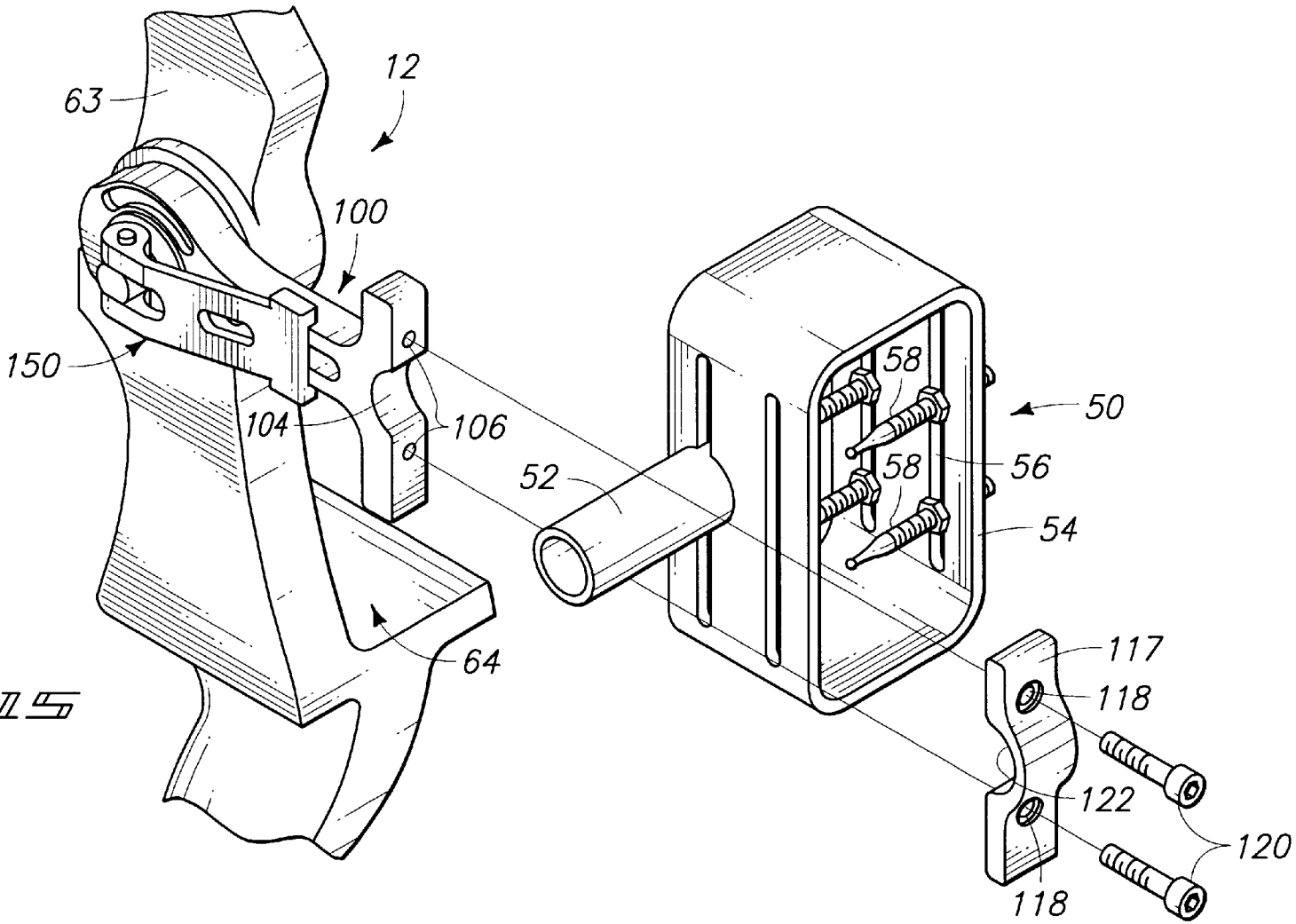
FIG. 15 is a fragmentary perspective view of a connector apparatus at on e method step for removably securing an archery bow accessory onto an archery bow in accordance with a first embodiment bracket of the present invention.
Figure 11:
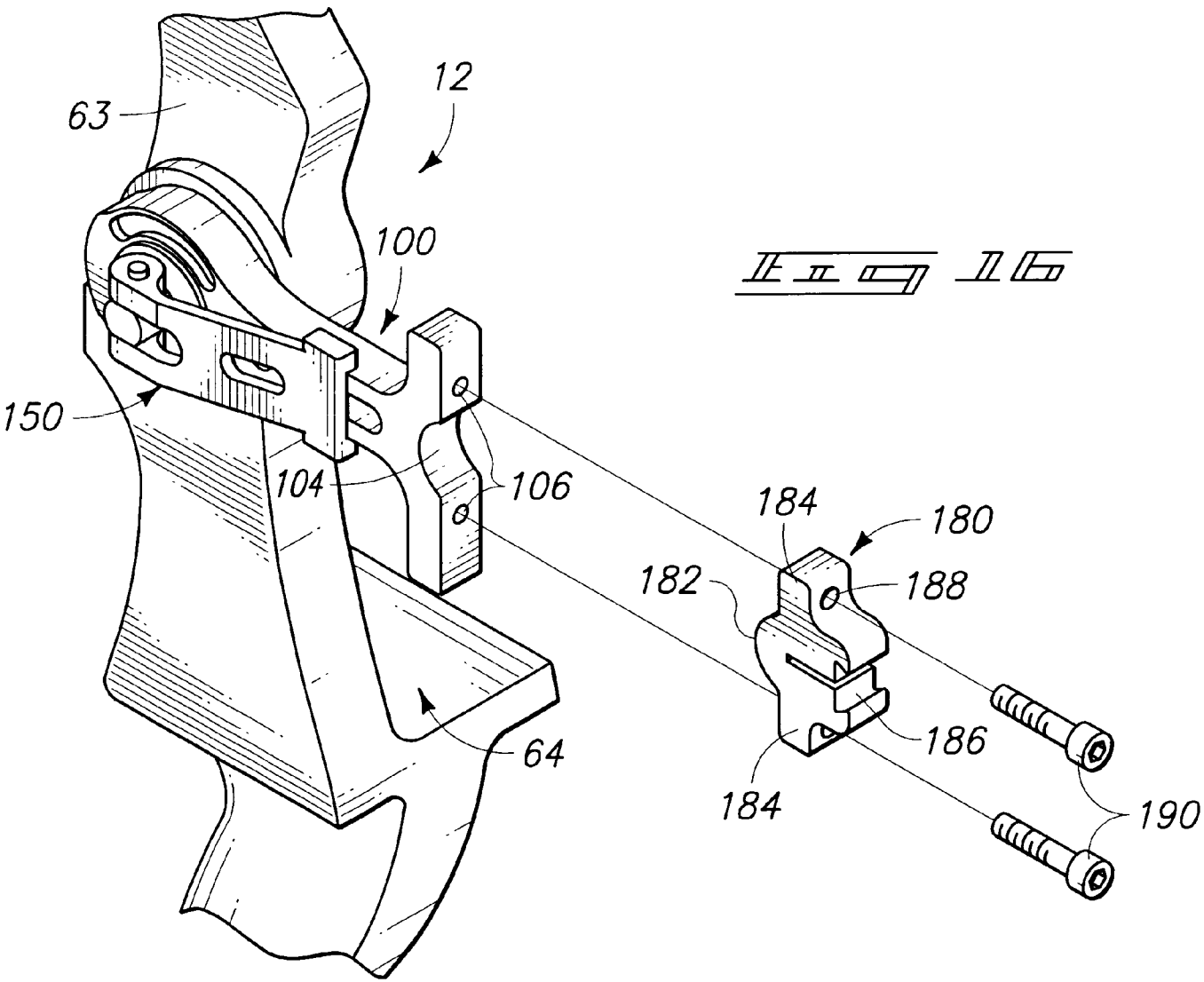

Referring to FIG. 15, an exemplary method of removably securing accessory 50 to base 100 is illustrated according to a first embodiment of the present invention. An exemplary accessory 50 includes a sighting mechanism that has a rectangular housing 54 with opposite sides, each side defining a set of vertically extending linear slots 56 (only one referenced) and a plurality of sighting prongs 58 that extend into the housing 54 from one set of the slots 56. A side of housing 54 opposite prongs 58 includes the barrel 52 extending laterally outwardly therefrom. First portion 102 of base 100 and bracket 117 define concave surfaces 104 and 122, respectively. A portion of barrel 52 is positioned in concave surface 104 of base 100 and bracket 117 is placed over barrel 52 with an other portion of barrel 52 in concave surface 122. Threaded members 120 are provided in aligned openings 106 and 118 of first portion 102 and bracket 117, respectively, to secure barrel 52 and accessory 50 to bow 10. It should be understood that the method just described to removably secure accessory 50 to base 100 utilizing bracket 117 could be performed before, or after, removably securing base 100 to handle 12 of bow 10 as previously described referencing FIGS. 8–14.

Referring to FIG. 16, an exemplary method of removably securing an accessory to base 100 is illustrated according to a second embodiment of the present invention. Bracket 180 has a convex surface 182 and is secured to first portion 102 of base 100 with convex surface 182 positioned in concave surface 104 via threaded members 190 provided in aligned openings 106 and 188 of base 100 and bracket 180, respectively. Bracket 180 has an outwardly exposed wall opposite convex surface 182 and defines a dovetail slot 186. The dovetail slot 186 is configured to receive a complementary configured dovetail horizontal adjustment (not shown) attached to an accessory (not shown). It should be understood that the method just described to removably secure an accessory to base 100 utilizing bracket 180 could be performed before, or after, removably securing base 100 to handle 12 of bow 10 as previously described referencing FIGS. 8–14.

It should be understood that an accessory could be removably secured directly to first portion 102 of base 100.

It should be understood that base 100 could define a plurality of openings 114 incrementally spaced from first portion 102.

It should be understood that an embodiment (not shown) of base **100*a* could include a locking pin 84*a* secured to the base 100*a* to prevent axial movement along the stem axis 30 while permitting rotation about the stem axis 30. Locking pin 84*a* includes a lever 150*a* secured thereon in one position relative the locking 84*a* and used to rotate the pair of projections 93*a* about the stem axis 30. Ring 66*a* defines an opening 68*a* generally having a cylindrical periphery with ledges 76*a* configured as helical spirals angling downward relative an outer surface 72*a*. The pair of projections 93*a* are positioned beneath ledges 76*a* and rotated about the stem axis 30 wherein the pair of projections 93*a* engage ledges 76*a*, and wherein continued rotation of the pair of projections 93***a* engages the downwardly spiraling ledges 76*a* to bias the locking pin 84*a* downwardly, and correspondingly, the base 100*a* onto handle 12*a* and bow 10*a*.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A connector apparatus for removably securing archery bow accessories to an archery bow, the connector apparatus comprising:

a base discrete from the bow and having a first portion configured for removably securing an archery bow accessory thereon and a second portion spaced from the first portion; and a stem defining a stem axis and extending axially from the second portion, the stem terminating to define at least one projection extending laterally and generally perpendicularly relative the stem axis, a pair of projections spaced from the second portion of the base.

2. The apparatus of claim 1 wherein the stem terminating defines a pair of projections extending laterally in opposite directions generally perpendicular to the stem axis.

3. The apparatus of claim 2 wherein the second portion defines at least one opening extending through the base from opposite sides of the second portion, and wherein the stem is discrete from the base and axially received in the opening for rotational movement about the stem axis, the stem defining an end opposite the pair of projections and outward of the base, the apparatus further comprising a lever secured to the end of the stem.

4. The apparatus of claim 3 wherein the lever secured to the end comprises a pivotal connection permitting the lever to pivot about a pivot axis generally perpendicular to the stem axis.

5. The apparatus of claim 4 wherein the lever terminates adjacent the end opposite the pair of projections to comprise a pivot end defining at least one eccentric peripheral surface radially spaced about the pivot axis to at least partially surround the pivot axis.

6. The apparatus of claim 5 wherein the permitting the lever to pivot about a pivot axis defines a range of pivot motion for the lever, and wherein the eccentric peripheral surface contacts the base during at least a portion of the range of pivot motion to move the stem along the stem axis.

7. The apparatus of claim 6 wherein the pivot end of the lever defines two eccentric peripheral surfaces aligned on opposite sides of the stem.

8. The apparatus of claim 6 wherein the radial spacing between the eccentric peripheral surface and the pivot axis comprises a varying dimension as the eccentric peripheral surface surrounds the pivot axis, wherein the varying dimension varies at a variable rate.

9. The apparatus of claim 8 wherein the variable rate of the varying dimension comprises a peak dimension intermediate the range of pivot motion.

10. The apparatus of claim 9 wherein the varying dimension increases at a constant rate before the peak dimension, and wherein the varying dimension decreases at a constant rate after the peak dimension.

11. The apparatus of claim 8 further comprising a resilient material between the eccentric peripheral surface and base wherein the resilient material compresses as the varying dimension increases during the pivoting of the lever about the pivot axis.

12. The apparatus of claim 3 wherein one of the opposite sides of the second portion of the base defines an outer face to be received adjacent an archery bow, and wherein the outer face defines an extension projecting outwardly from the face.

13. The apparatus of claim 3 wherein one of the opposite sides of the second portion of the base defines an outer face to be received adjacent an archery bow, and wherein the outer face defines a plurality of extensions projecting outwardly from the face, and wherein the extensions are radially spaced about the opening.

14. The apparatus of claim 3 further comprising a discrete member removably secured to the first portion of the base for retaining a portion of an archery bow accessory between the first portion and discrete member.

15. The apparatus of claim 3 wherein the first portion of the base defines an outwardly facing wall comprising a concave surface.

16. The apparatus of claim 3 further comprising a discrete member removably secured to the first portion of the base, the discrete member comprising an outwardly facing portion defining a dovetail slot.

17. The apparatus of claim 2 further comprising a discrete body to be removably secured to an archery bow, the discrete body defining an outer surface and a bore having a peripheral wall extending from the outer surface to a lowermost elevation spaced from the outer surface, a pair of ledges extending laterally inwardly from opposite sides of the peripheral wall, the pair of ledges spaced from the lowermost elevation.

18. The apparatus of claim 17 wherein the bore is configured to receive the pair of projections of the stem axially therein, and wherein the spacing between the ledges and the lowermost elevation comprises a periphery of the bore configured to allow the pair of projections to rotate about the stem axis.

19. The apparatus of claim 17 wherein one of the opposite sides of the second portion of the base defines an outer face to be received adjacent an archery bow, and wherein the outer face defines a plurality of extensions projecting outwardly from the face, and wherein the discrete body defines corresponding recesses configured to receive the plurality of extensions in complementary fashion.

20. A connector apparatus for removably securing archery bow accessories to an archery bow, the connector apparatus comprising:

a base comprising a first portion configured for removably securing an archery bow accessory thereon, and a second portion spaced from the first portion and defining at least one opening extending through the base from opposite sides of the second portion; and a discrete stem defining a stem axis and received in the opening for rotational movement about the stem axis and for axial movement along the stem axis, the stem having opposite ends outward of the opposite sides of the second portion, a first end defining a pair of projections extending laterally in opposite directions from the first end, and a second end; and a lever pivotally secured to the second end of the stem for pivotal motion about a pivot axis generally perpendicular to the stem axis, the lever defining a camming surface radially spaced about the pivot axis and contacting the base during the pivotal motion to axially move the stem along the stem axis.

21. A connector ring for removably securing archery bow accessories to an archery bow, the connector ring comprising a discrete body to be removably secured to an archery bow, the discrete body defining an outer surface and an opening having a peripheral wall extending from the outer surface to a lowermost elevation spaced from the outer surface, the peripheral wall defining a pair of ledges extending laterally inwardly from opposite sides of the peripheral wall, the pair of ledges spaced from the lowermost elevation; and wherein the outer surface defines a plurality of slots radially extending from and spaced about the opening.

22. The connector ring of claim 21 wherein the discrete body is removably secured to the archery bow by a plurality of threaded members with the outer surface exposed.

23. An archery bow comprising:

a handle having a first end, a second end opposite the first end and an outer surface, the handle defining an opening having a peripheral wall extending from the outer surface to a lowermost elevation in the handle spaced from the outer surface, a pair of ledges extending laterally inwardly from opposite sides of the peripheral wall, the pair of ledges spaced from the lowermost elevation;

a first limb extending outwardly from the first end of the handle and a second limb extending outwardly from the second end of the handle; and at least one string extending between distal ends of the limbs.

24. The bow of claim 23 wherein the outer surface and opening are defined by a body discrete from the bow and removably secured to the handle.

25. The bow of claim 23 further comprising:

a base discrete from the bow and having a first portion configured for removably securing an archery bow accessory thereon and a second portion spaced from the first portion; and a stem defining a stem axis and extending axially from the second portion, the stem terminating to define a pair of projections extending laterally in opposite directions generally perpendicular to the stem axis, the pair of projections configured to be received in the opening of the handle beneath the ledges relative the outer surface.

26. The bow of claim 25 wherein the second portion defines at least one opening extending through the base from opposite sides of the second portion, and wherein the stem is discrete from the base and secured in the opening for rotational movement about the stem axis with the pair of projections outward of one side of the base, the stem defining an end opposite the pair of projections and outward of the opposite side of the base, the apparatus further comprising a lever secured to the end opposite the pair of projections.

27. The bow of claim 26 wherein the lever secured to the end opposite the pair of projections comprises a pivotal connection permitting the lever to pivot about a pivot axis generally perpendicular to the stem axis, and wherein the lever terminates adjacent the end opposite the pair of projections to comprise a pivot end defining at least one eccentric peripheral surface radially spaced about the pivot axis to at least partially surround the pivot axis.

28. A method for removably securing an archery bow accessory to an archery bow, the method comprising:

providing an archery bow having an outer surface defining an opening, the opening having peripheral walls extending from the outer surface into the bow to define a bottom wall spaced from the outer wall, a pair of ledges extending laterally inwardly from opposite sides of the peripheral wall, the ledges spaced from the bottom wall;

providing a base discrete from the bow and having a first portion configured for removably securing an archery bow accessory thereon and a second portion spaced from the first portion, the second portion defining a stem extending axially from the second portion and terminating to define a pair of projections extending laterally in opposite directions generally perpendicular to the stem; and positioning at least a portion of the stem axially in the opening of the bow.

29. The method of claim 28 further comprising rotating the pair of projections about the axis of the stem to position the pair of projections between the ledges and bottom wall.

30. The method of claim 29 further comprising biasing the pair of projections along the axis of the stem to position the pair of projections abutting against the ledges.

31. The method of claim 28 further comprising securing an archery bow accessory to the first portion of the base.

32. The method of claim 28 further comprising securing an archery bow accessory to the first portion of the base after the positioning the at least a portion of the stem.

33. The method of claim 28 further comprising:

positioning a section of an archery bow accessory against the first portion of the base; and securing a bracket to the first portion over the section of the accessory.

34. A connector ring for removably securing archery bow accessories to an archery bow, the connector ring comprising a discrete body to be removably secured to an archery bow, the discrete body defining an outer surface and an opening having a peripheral wall extending from the outer surface to a lowermost elevation spaced from the outer surface, the peripheral wall defining a pair of ledges extending laterally inwardly from opposite sides of the peripheral wall, the pair of ledges spaced from the lowermost elevation; and wherein the discrete body is removably secured to the archery bow by a plurality of threaded members with the outer surface exposed.

* * * * *